US005240180A

United States Patent [19]

Feuillerat et al.

[11] Patent Number: 5,240,180

[45] Date of Patent: Aug. 31, 1993

[54] WATER FILM COOLING MODULAR NOZZLE PARTICULARLY FOR HIGH TEMPERATURE TESTING OF SPECIMENS OR SIMILAR

[75] Inventors: Jean Feuillerat, Bordeaux; René G. G. M. Leroux, Merignac, both of France

[73] Assignee: Societe Anonyme Aerospatiale Societe Nationale Industrielle, Paris, France

[21] Appl. No.: 889,405

[22] Filed: May 28, 1992

[30] Foreign Application Priority Data

Jun. 7, 1991 [FR] France ..... 91 07188

[51] Int. Cl.[5] ..... B05B 15/00

[52] U.S. Cl. ..... 239/132.3; 239/139

[58] Field of Search ..... 239/132, 132.1, 132.3, 239/132.5, 135, 139

[56] References Cited

U.S. PATENT DOCUMENTS

| | | | |
|---|---|---|---|
| 3,149,222 | 9/1964 | Giannini et al. . | |
| 3,803,380 | 4/1974 | Ragaller . | |
| 4,369,919 | 1/1983 | Below et al. | 239/132.3 X |
| 4,420,116 | 12/1983 | Warlick | 239/152.3 X |
| 4,421,496 | 12/1983 | Gulden et al. | 239/132.3 X |
| 4,502,633 | 3/1985 | Saxon | 239/132.3 |
| 4,548,033 | 10/1985 | Cann . | |
| 4,577,461 | 3/1986 | Cann . | |

FOREIGN PATENT DOCUMENTS

| | | | |
|---|---|---|---|
| 860436 | 7/1949 | Fed. Rep. of Germany | 239/132.3 |
| 1189573 | 3/1959 | France | 239/132.3 |
| 1368255 | 12/1964 | France . | |
| 2450029 | 9/1980 | France . | |

*Primary Examiner*—Andres Kashnikow
*Assistant Examiner*—Kevin Weldon
*Attorney, Agent, or Firm*—Sandler Greenblum & Bernstein

[57] ABSTRACT

A water film cooling modular nozzle for high temperature testing of specimens or similar comprising a rather long divergent in relation to the throat diameter, consisting of a metal section including the convergent, the throat and the beginning of the divergent and one or several divergent sections also metallic, the various sections being end to end assembled, and in that the outer wall of each section is independently cooled with a thin water film, the unit consisting of the sections and the separators being enclosed in a fixed outer shell defining, opposite each section, an independent cooling fluid circulation chamber containing the separator, the arrangement being such that a clearance with respect to the longitudinal axis of said unit in relation with said shell is allowed in order to absorb the thermal expansion of the nozzle.

25 Claims, 4 Drawing Sheets

WATER FILM COOLING MODULAR NOZZLE PARTICULARLY FOR HIGH TEMPERATURE TESTING OF SPECIMENS OR SIMILAR

BACKGROUND OF THE INVENTION

The present invention relates to a new process for realizing a nozzle intended particularly for high temperature testing of specimens or similar, particularly of materials that must withstand high thermal and pressure stresses.

The invention particularly concerns, although not exclusively, the plasma nozzles located at the exit of a plasma generator likely to provide, in accordance with the testing specifications, static test pressures that can reach and even exceed 100 bars and limited generating enthalpies reaching 170 or more.

The invention concerns, more precisely, the nozzles of the above-mentioned type consisting of a rather long divergent of the order of several tens of centimeters, having a flat shape and a super-elliptic type section.

Conventional nozzles, particularly regarding the divergent, have a complicated profile and, therefore, pose manufacturing problems.

Further the very important heat flows cause nozzle overheating and expansion problems that must be overcome.

SUMMARY OF THE INVENTION

It is an object of the present invention to provide a new embodiment of the above-mentioned type of nozzles ensuring easier manufacturing, and controlling the overheating phenomena and their consequences.

To that end, it is an object of the invention to provide a water film cooling modular nozzle, particularly for the high temperature testing of specimens or similar, of the type including a rather long divergent in relation to the throat diameter and, more particularly, having a flat section of super-elliptical type or the like, characterized in that it comprises a metal section including the convergent, the throat and the initial part of the divergent and of at least one divergent section which is also metallic, the various sections being mounted end to end, and in that the outer wall of each nozzle section is independently cooled by a thin water film or another suitable cooling fluid that circulates at high speed, and which is confined against the wall by a suitably shaped separator, the combined unit of the nozzle sections and the separators being enclosed in a fixed outer shell, which is coaxial with the nozzle and defining, opposite each section, an independent cooling fluid circulation chamber wherein the separator is placed, the arrangement being such that a clearance with respect to the longitudinal axis of the unit is allowed in relation to the outer shell in order to absorb the thermal expansion of the nozzle.

The outer shell, for example, is made of as many sections as there are nozzle sections, and, once they are assembled, the nozzle sections define, at both ends and at the connections between sections, resting radial flanges sliding against inner wall having generating lines parallel to the nozzle axis, provided for in the corresponding sections of the shell.

Preferably, the rigid nozzle sections unit is made solid with the shell at the level of the section of the downstream end.

Each cooling fluid circulation chamber comprises a separator in two half-parts, axially movable together with the considered nozzle section thanks to adjusting pieces inserted between the separator and the radial walls of the nozzle sections flanges on the one hand, and the respective shell sections, on the other hand, said pieces giving a specific constant thickness to said thin cooling fluid film, mainly opposite the inner wall of each nozzle section, each shell section being provided with appropriate cooling fluid inlet and outlet.

The whole unit of the nozzle sections is made solid with the outer shell, at the level of the downstream end section, thanks, for example, to a ring-shaped key inserted between the downstream section of the shell and the associated separator, passages being provided for in the key for the cooling fluid circulation, the lateral fastening of the whole unit of the nozzle sections and of their associated separators in relation to the shell, being obtained thanks to a piece which is solid with the downstream end separator, and which is inserted in an oblong opening parallel to the nozzle axis, provided for in the inner wall of the considered shell section.

For a better tightness between the nozzle and the shell, at both ends of the unit, the circumference of the nozzle end flanges is advantageously provided with an inner return that increases the contact surface with the shell receiving inner surfaces, joints being set opposite the contact surface, and the separators of both end sections are made of two parts fitting one into the other so as to allow the separator to be inserted under said returns.

Advantageously, the outer wall of the nozzle section is provided, at least opposite the approximately plane parts, with stiffening ribs overlapped by the separators that are shaped to this end.

The various nozzle sections are, for example, made of copper alloy and advantageously electro-erosion machined.

Insofar as concerns a nozzle showing a plane part in the downstream zone of the divergent, such zone can be fitted with a removable cold or hot plate, the cold plate being meant for increasing the cooling of the nozzle locally, whereas the hot plate is meant for reducing the cooling locally, when specific tests are carried out, such plates being arranged in continuity with said plane part in the downstream section of the nozzle and possibly the previous section, the upper side of said cold or hot plate forming together with the associated front side of the nozzle downstream end, an angle less than 90° so as to realize negative incidence "plane board" tests.

BRIEF DESCRIPTION OF THE DRAWINGS

These and other objects and advantages of the invention will be more fully set forth in the following description of an embodiment of a nozzle according to the invention, a description given as an example only and considered in connection with the accompanying drawings, wherein:

FIGS. 1 and 2 show a nozzle with a super-elliptic section type divergent.

DETAILED DESCRIPTION OF THE PREFERRED EMBODIMENTS

Figure 1:
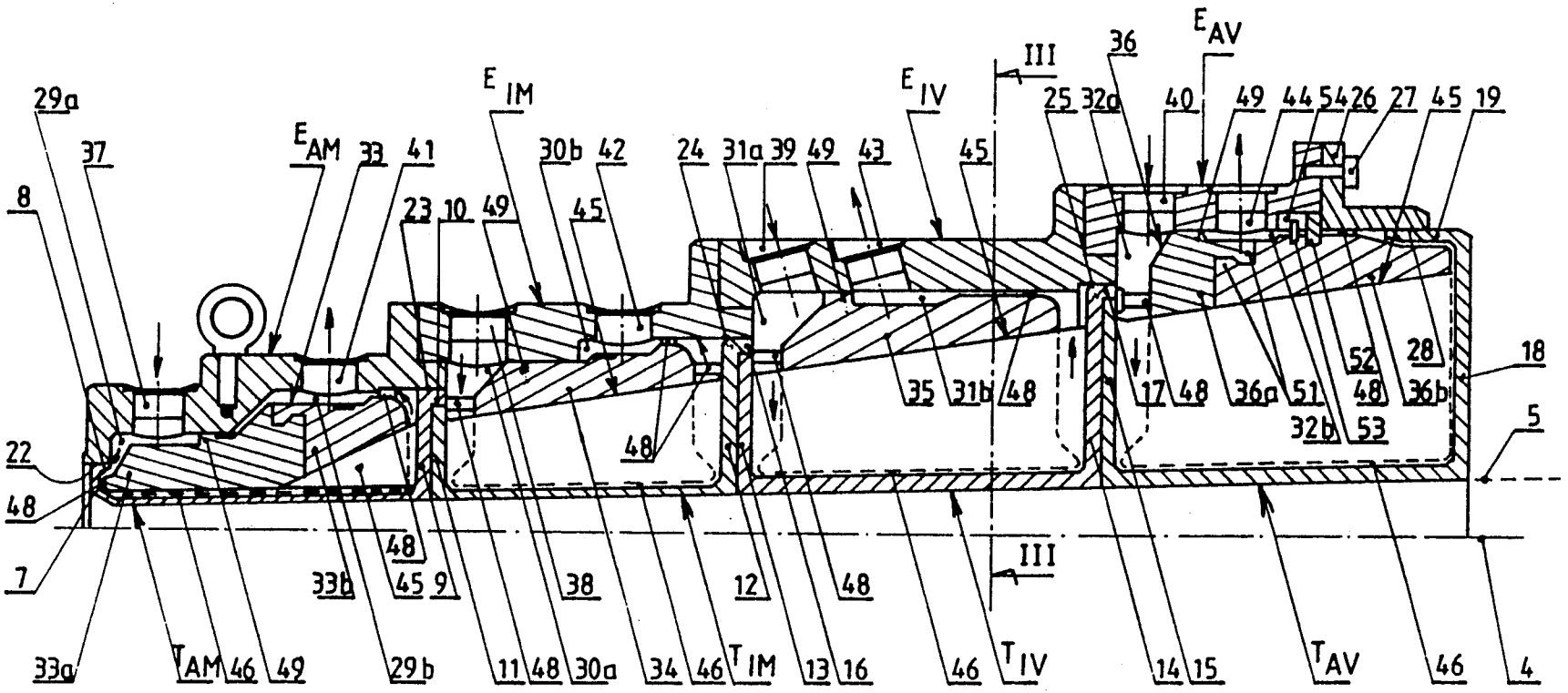
FIG. 1 is an axial half-section of a nozzle in accordance with the invention, of super-elliptic section divergent type, the section being along the small axis.

This type of nozzle as described in the French patent application FR-91 06423, which corresponds to copending U.S. application Ser. No. 07/886,394, filed May 21, 1992, as applied for by the same assignee, comprises a very short convergent 1 of a few centimeters at most, a throat 2 and a very long divergent 3 in relation to the diameter of the throat, of some tens of centimeters, the divergent section being of super-elliptic type, the shape (half-section) being represented in FIG. 3, that is relatively flattened and lying on two rectilinear generating lines defined by two planes at right angles, containing the axis 4 of the nozzle, one of the generating lines being claimed a small axis generating line and indicated at 5 in FIGS. 1 and 3, and the other being called a long axis generating line and indicated at 6 in FIGS. 2 and 3.

In the embodiment shown, the nozzle consists of four sections that are assembled end to end, namely, an upstream end section $T_{AM}$ defining the convergent 1, the zone of the throat 2 and the beginning of the divergent 3, an intermediary upstream section $T_{IM}$, a downstream section $T_{IV}$ and a downstream end section $T_{AV}$.

Each section comprises, at each end, a radial flange allowing to assemble the sections and defining at both ends of the nozzle the front side and the rear side of the latter.

More precisely, the upstream section $T_{AM}$ comprises a flange 7 with a return 8 around the circumference that defines an outer bearing surface whose generating lines are parallel to the nozzle axis, the flange 7 forming the rear side of the nozzle. The other end of the section $T_{AM}$ comprises a radial flange 9 also equipped with a return 10 defining an outer bearing surface whose generating lines are parallel to the nozzle axis, and acting as a shoulder for the radial flange 11 of the following section $T_{IM}$.

The connection between the sections $T_{IM}$, $T_{IV}$ and $T_{AV}$ is realized in the same way, with the radial flanges 12, 13, 14 and 15 and the returns 16 and 17 defining outer bearing surfaces similar to those of the returns 8 and 10.

The nozzle nose is defined by a radial flange 18 that is equipped with an inner return 19 defining an outer bearing surface similar to that of the returns 8, 10, 16 and 17.

The various returns 8, 10, 16, 17, 19 have their diameter stepped so as to take the widening of the divergent into account.

Figure 2:
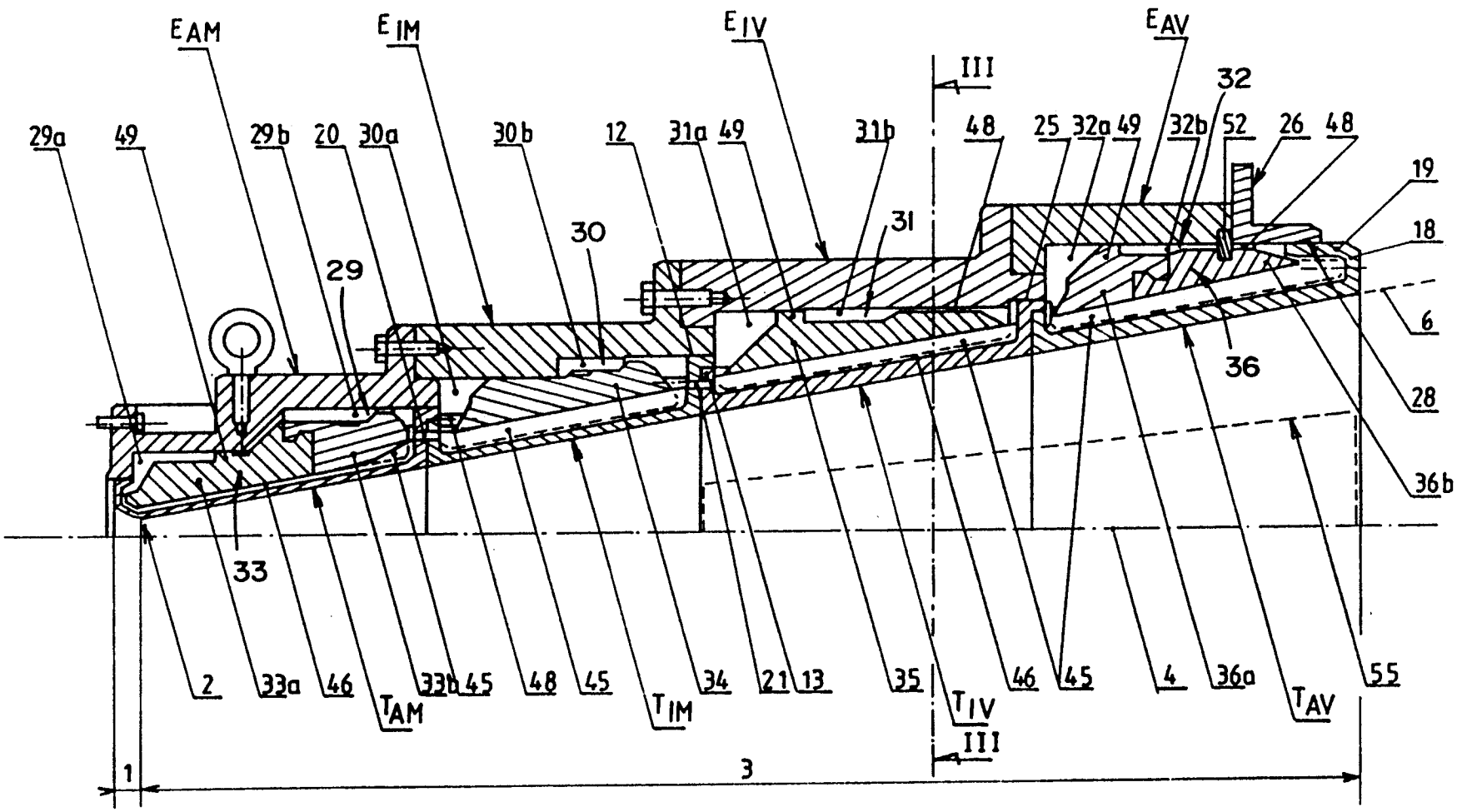
FIG. 2 is an axial half-section of the same nozzle along the long axis.

The mounting of the sections is realized by means of screws, such as those indicated at 20 in FIG. 2, engaged in the facing flanges and regularly distributed on the periphery, and the rotating adjustment is realized by means of pieces such as those indicated at 21 in FIG. 2, arbearing surfaced in the same way as the screws 20.

The sections $T_{AM}$, $T_{IM}$, $T_{IV}$ and $T_{AV}$ thus form a rigid unit that can slide along an axis inside a rigid outer shell consisting of as many sections as there are nozzle sections.

To the section $T_{AM}$, corresponds the shell section $E_{AM}$ provided with, at both ends, two inner bearing surfaces 22 and 23 with generating lines parallel to the nozzle axis, in contact with the returns 8 and 10, respectively. To the section $T_{IM}$, corresponds the shell section $E_{IM}$ fixed to the section $E_{AM}$ and defining an inner bearing surface 24 of the same nature as the returns 22, 23 and in contact with the return 16.

The shell section $E_{IV}$ is similar to the section $E_{IM}$ and comprises an inner bearing surface 25 that is in contact with the return 17.

The downstream end shell section is defined by a part $E_{AV}$ that is fixed to the previous section $E_{IV}$ and by an assembling ring 26 fixed to the part $E_{AV}$ by means of screws such as those indicated at 27 in FIG. 1, and defining an inner bearing surface 28 with generating lines parallel to the axis of the nozzle and in contact with the return 19 of the nozzle nose.

Seals are provided between the returns 7, 10, 16, 17, 19 and the bearing surface receiving the shell elements as well as between the pairs of flanges 9, 11; 12, 13 and 14,15.

The ring 26 is meant for mounting the nozzle on an external holding structure that is not represented and is the only fixing point of the nozzle shell. The fastening of all the sections of the nozzle in relation to the shell will be further described.

Each shell section $E_{AM}$, $E_{IM}$, $E_{IV}$, $E_{AV}$ defines an inner wall cooling chamber of the nozzle with the corresponding nozzle section.

There are four independent cooling chambers, 29, 30, 31 and 32, respectively, in which are created thin cooling water films on the outer sides of sections parts forming the wall of the nozzle by means of suitably shaped parts called separators.

In each cooling chamber 29, 30, 31 and 32, a separator, respectively 33 to 36, split the chamber into an upstream zone (throat side of the nozzle), respectively 29*a* to 32*a*, and a downstream zone 29*b* to 32*b*.

The upstream zone communicates, through a passage provided for in the outer shell, respectively 37 to 40, with several independent cooling water or other fluid sources, whereas the downstream zone communicates, through a second passage also provided for in the shell, 41 to 44, respectively, with the return circuit of the cooling fluid.

In the embodiment shown the substantially plane part of the nozzle wall defined by the various sections $E_{AM}$, $E_{IM}$, $E_{IV}$, $E_{AV}$ is provided with (FIGS. 1, 2 and 3) stiffening ribs 45 that are positioned in the various cooling chambers, the thickness of the nozzle wall being rather small.

Figure 3:
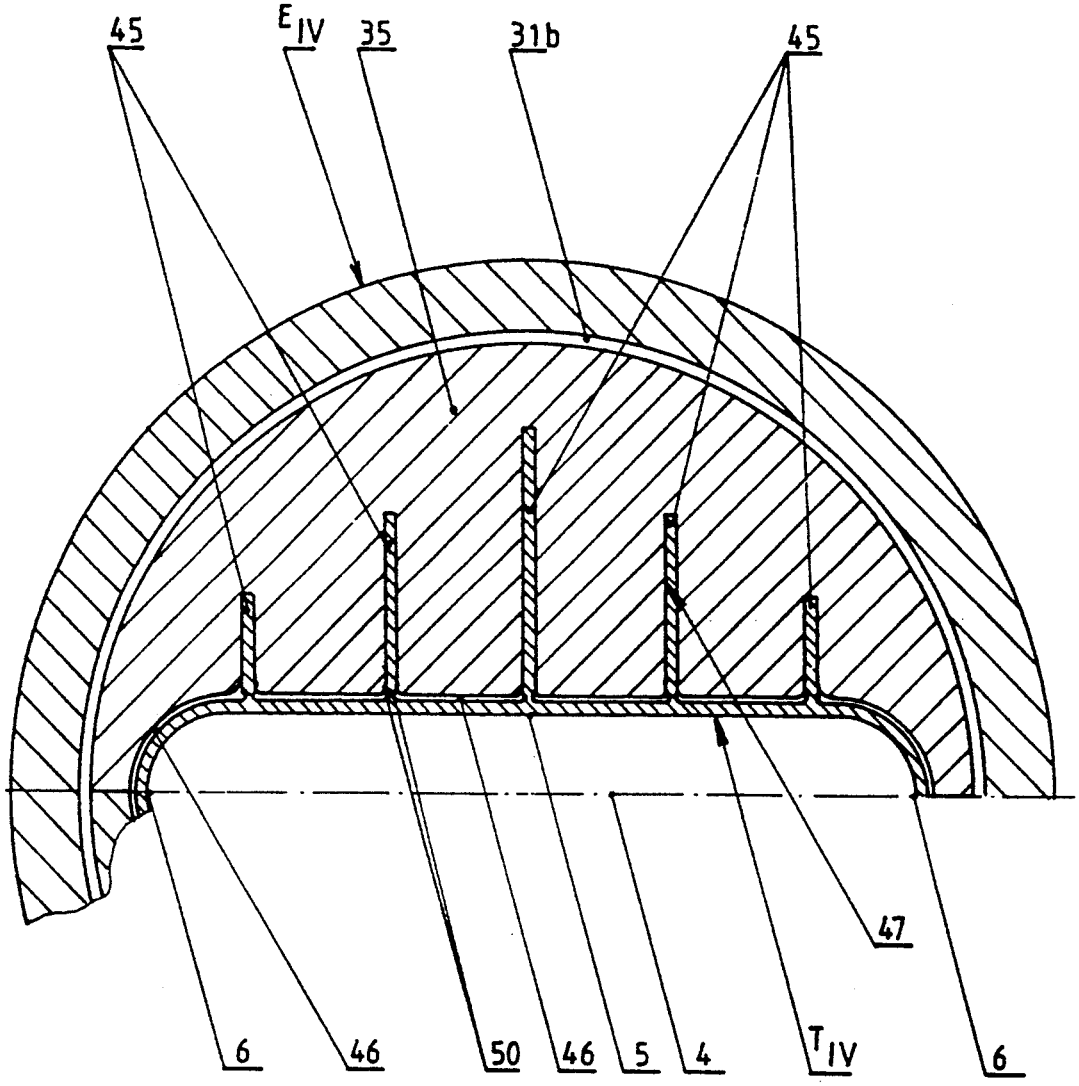
FIG. 3 is a cross-section of the nozzle divergent taken on lines III—III of FIGS. 1 and 2.

More specifically and for making the realization and the setting of the overlapping separators 33 to 36 easier, the ribs 45 are mutually perpendicular to the plan of the nozzle that contains the long axis generating lines 6 (as shown in FIG. 3), are parallel to each other (as shown in FIG. 3) or not.

The height and the thickness of the ribs 45 may vary.

The nozzle sections $T_{AM}$, $T_{IM}$, $T_{IV}$, $T_{AV}$ are, for example, copper alloy monobloc parts manufactured by electro-erosion, whereas each section of shell $E_{AM}$, $E_{IM}$, $E_{IV}$, $E_{AV}$ is also a monobloc part of circular section preferably, for making the manufacturing easier.

Each separator 33 to 36 is realized in two half-parts assembled according to a joining plan similar to the one that contains the long axis generating lines 6 of the nozzle (see left side in FIG. 3).

If the nozzle is symmetrical in relation to the plane containing the generating lines 6, all the separators are made of symmetrical half-parts 33*a*, 33*b*; 34*a*, 34*b*; 35*a*, 35*b*; and 36*a*, 36*b*. As will be further illustrated the case where the lower plane part of the divergent is provided with a cold plate or hot plate, in its downstream part, such embodiment requires the local modification of the separator of the cooling chamber(s).

In FIG. 3 there is shown a cross section of the upper half-part of the separator 35 taken on line III—III in FIGS. 1 and 2.

The separator is dimensioned and designed so as to delimit a small and calibrated interval 46 between the side facing the wall of the nozzle and the section $T_{IV}$. Throats 47 are provided for in the separator 35 in order to receive the ribs 45.

The small interval 46 only exists opposite the wall of the nozzle, the separator being set back from the flanges 13 and 14 as well as from the section $E_{IV}$ of the wall.

Spacer pins 48 are inserted in those intervals and thus calibrate the thickness of the water film that circulates in the interval 46.

The separation between the upstream and downstream zones, respectively 31*a* and 31*b*, of the cooling chamber is delimited from the section $E_{IV}$ of the shell by a projecting part 49 in contact with an inner bearing surface having generating lines parallel to the nozzle axis and preferably being cylindrical like the other bearing surfaces. All the separators have a similar part 49.

Preferably, as indicated at 50 in FIG. 3, the connecting angles of the ribs 45 with the nozzle wall are substantially rounded so as to reduce pressure drops of the cooling fluid feeding.

Because of the presence of the projecting end returns 22 and 28, contrary to the returns 23, 24 and 25 and so as to allow the setting of the end separators 33 and 36, each half-part of the separators is also made of two parts 33*a*, 33*b* and 36*a*, 36*b*, that are successively mounted and that fit together thanks to complementary assembling parts 51.

The separators 33 to 36 are mounted so as to be joined to the sections of the nozzle, and to move with the latter inside the outer shell of the nozzle, after the thermal expansion of the nozzle, for example, thanks to the contacting bearing surfaces between the shell and the nozzle sections-separators unit.

The unit is fixed to the shell in a point that is located very close to the mounting ring 26.

The axial mounting of the nozzle is ensured by a ring-shaped key 52, preferably circular, engaged into a ring groove made in part 36*b* of the separator, on one side, and on the other side, into a ring groove made in section $E_{AV}$ of the shell between such section and the ring 26.

The lateral adjustment, that is to say when the nozzle sections-separators unit is rotating in the outer shell, is carried out by a radial piece 53 solid with art 36*b* of the separator and engaged in an oblong opening 54 that is parallel to the axis of the nozzle and provided in section $E_{AV}$ of the shell.

With such mounting, the expansion of the nozzle nose due to heat is very small since it concerns the part that is downstream of the key 52. Such an expansion conduces to move the nozzle nose away from the ring 26.

The expansion of the part of the nozzle that is located upstream the key 52 is more important and is easily absorbed by a sliding motion of the nozzle sections-separators unit in the outer shell, toward the upstream end of the nozzle.

The key 52 is inserted in the downstream zone 32*b* of the cooling chamber and should be provided with passages (not shown) ensuring the free circulation of the cooling fluid in the zone 32*b*, on each side of the key.

The significance of realizing a nozzle made of several sections consists in having the possibility of changing the worn nozzle section, the parts of the nozzle being irregularly worn, and in making the manufacturing easier, the present invention allowing the use of present performance of electro-erosion manufacturing machines, since the dimensions of the various sections can be reduced.

The separators and the outer shell are made of for example, aluminum.

Figure 4:
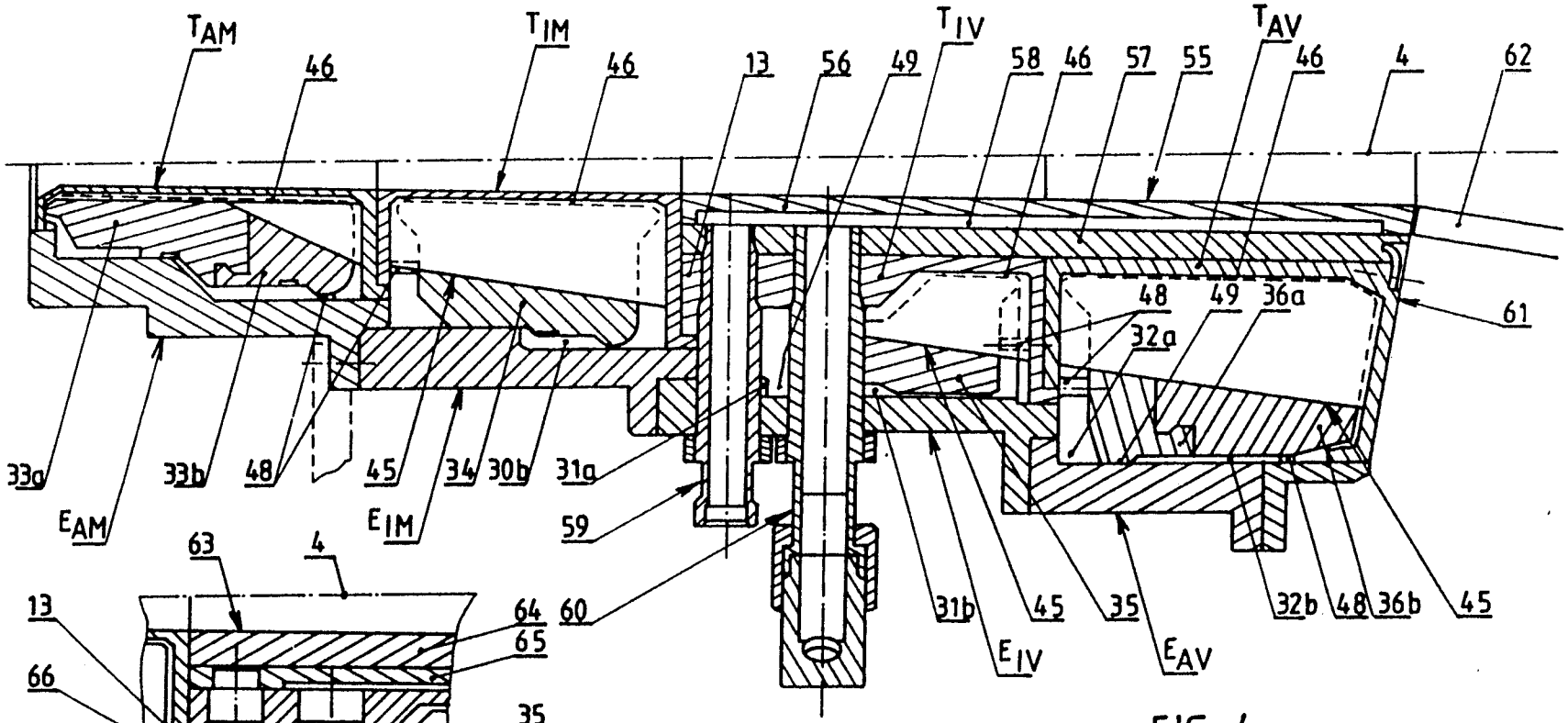
FIG. 4 is a partial axial section along the small axis of the nozzle lower part in FIG. 1, showing a variant equipped with a cold plate.

FIG. 4 shows an alternative embodiment of a nozzle according to FIGS. 1 to 3, equipped with a cold plate filling part of the approximately plane lower wall of the divergent, at the level of the last two sections $T_{IV}$ and $T_{AV}$.

The corresponding separators, the cooling chambers and the outer shell sections should be modified accordingly.

The divergent in FIG. 4 is fitted with a trapezoid plane cold plate 55 (FIG. 2).

The cold plate includes a first metal plate 56 set out in continuity with the inner wall of the nozzle, fixed on a second metal plate 57, and a fluid circulation circuit 58 arranged between both plates, allowing to modify and more precisely to reduce the heat flow at the nozzle outlet.

The circuit 58 is connected to outer circuits via pipes or collectors 59, 60 tightly crossing the section $E_{IV}$ of the shell, the cooling chamber (31*a* and 31*b*) and the separator 35.

Both nozzle sections $T_{IV}$ and $T_{AV}$ are specially designed so as to present a hollow for receiving the cold plate 55. The cooling chambers, the separators and the sections of the outer shell $E_{IV}$ and $E_{AV}$ are also designed accordingly.

The embodiment represented in FIG. 4 also shows the provision for a front side 61 of the nozzle, on its lower part, sloping backward so that the side 61 forms together with the axis 4 of the nozzle an angle below 90° allowing to adjust a negative slant of the plane board test specimen indicated at 62. The slant side 61 can be provided with or without cold plate 55.

Supposing that the nozzle would be too much cooled, particularly for certain types of tests, the cold plate 55 can be advantageously replaced by a so-called hot plate.

Figure 5:
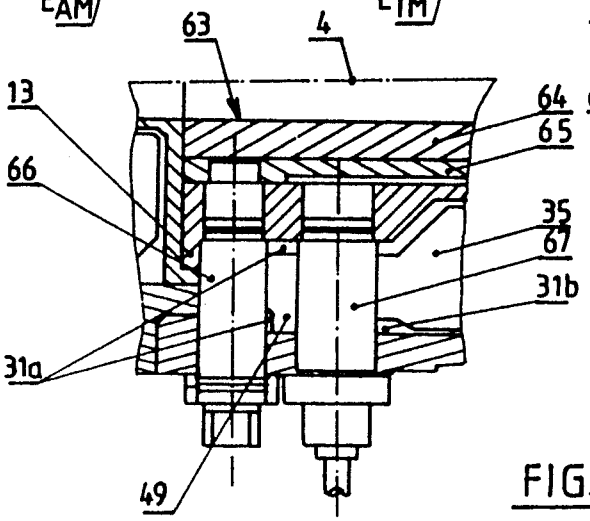
FIG. 5 is a partial view of a hot plate liable to replace the cold plate of FIG. 4.

FIG. 5 partly shows a hot plate 63 substituted to the cold plate 55.

The hot plate 63 comprises a silica foam plate placed in continuity with the inner wall of the nozzle and fixed, for example glued) face to face on a metal sole 65.

Fixing elements 66 and 67 of the plate 63 are provided for in place of the collectors 59, 60, also ensuring the tightness of the crossed cooling chamber (31*a*, 31*b*) and the passage for the conductors of the temperature measurement system.

The plate 63 forms a sort of screen for the cooling system of the nozzle sections $T_{IV}$ and $T_{AV}$, the interval 46 where the thin cooling fluid film is formed, opposite the plate 63 and the plate 55, being further from the inner wall of the nozzle.

The present invention has been described with reference to a super-elliptic type of nozzle with a relatively flattened divergent, but it is obvious that the essential technological provisions of the invention, such as, among others, the realization of the divergent in sections each being provided with an independent cooling circuit through which a thin fluid film circulates, upstream to downstream, at a high speed of the order of 20 m/s for example, which improves the convective coefficient, or that the sliding assembly of the unit nozzle-separators inside a fixed outer shell, could be applied to nozzles with relatively long divergent in relation to the diameter of the throat, or of other shapes, for example, of a super-elliptic section less flattened than the section shown in FIG. 3, or even of so-called square section or circular section (axisymmetric nozzle) or even semi-circular.

The cooling of the nozzle, which can be modulated thanks to the various independent circuits, allows a permanent flowing rate while the parts are not worn. It should be noted that the pressurization of the cooling fluid circuits can be controlled by the generating pressure provided by the generator, particularly of plasma, within the limits, for example, of a predetermined pressure variation.

The separators described and represented above have been designed so as to limit heat losses by creating a necking of the cooling fluid flow as close as possible to the side to be cooled, namely the wall of the nozzle, and in the form of a thin film with a carefully sized thickness. Their shapes and dimensions can obviously be adapted to those of the cooling chamber, to those of the sections of the shell and to the provision for possible fittings such as said cold and hot plates, measuring probes, etc.

The number of nozzle sections can obviously be higher or lower than four. The outer shell can eventually be realized in one part and not in sections, or in two half-shells preferably assembled according to a plane containing the long axes generating lines 6 of the nozzle.

What is claimed is:

1. A water film cooling modular nozzle, comprising:

(a) a convergent;

(b) a throat having a diameter;

(c) a divergent, said divergent having a length that is substantially longer than the diameter of said throad and having a flattened section;

(d) a first metallic section comprising said convergent, said throat and a beginning portion of said divergent, (e) at least one second metallic section comprising an additional portion of said divergent;

(f) said first metallic section and said at least one second metallic section being assembled in an end to end relationship forming a nozzle unit having a plurality of sections;

(g) a fixed outer shell substantially coaxial with said nozzle unit, and defining therebetween independent cooling fluid circulation chambers for each of said first metallic ssection and said at least one second metallic section;

(h) a separator within each independent cooling fluid circulation chamber to confine cooling fluid flow against an outer wall of each of said first metallic section and said at least one second metallic section to independently cool each section of said nozzle unit with a thin cooling fluid film flowing at high speed; and (i) a clearance, along the lonitudinal axis of said nozzle unit, in relation to said outer shell in order to absorb thermal expansion of said first metallic section and said at least one second metallic section.

2. The nozzle according to claim 1, wherein said outer shell is composed of a plurality of sections.

3. The nozzle according to claim 2, wherein said plurality of sections of said outer shell correspond in number to a number of sections of said plurality of sections of said nozzle unit.

4. The nozzle according to claim 3, wherein said nozzle unit defines at both ends and at each intersecting junction of the plurality of sections, resting radial flanges for sliding against inner walls of said outer shell.

5. The nozzle according to claim 4, wherein a line passing through said resting radial flanges and said inner walls of said outer shell is parallel to a longitudinal axis passign through said nozzle unit.

6. The nozzle according to claim 2, comprising a rigid connection, at a downstream section of said nozzle unit, between said downstream section and said outer shell.

7. The nozzle according to claim 1, wherein at least one said separator comprises two parts.

8. The nozzle according to claim 7, wherein said two parts are movable together with a corresponding section of said plurality of sections of said nozzle unit.

9. The nozzle according to claim 8, including spacer elements between said separator and walls of said plurality of sections of said nozzle unit, and between said separator and said outer shell.

10. The nozzle according to claim 9, wherein said spacer elements comprise spacer pins.

11. The nozzle according to claim 10, wherein each of said plurality of sections of said outer shell comprises at least one cooling fluid inlet and at least one cooling fluid outlet.

12. The nozzle according to claim 11, wherein said independent cooling fluid circulation chambers are constructed and arranged to permit cooling fluid flow upstream to downstream.

13. The nozzle according to claim 11, including elements to independently supply to each of said independent cooling fluid circulation chambers a fluid at controlled temperature and circulating speed.

14. The nozzle according to claim 6, wherein said rigid connection, at a downstream section of said nozzle unit, between said downstream section and said outer shell, comprises an annular key inserted between a downstream section of said outer shell and an associated spearator, and pasages being provided in said annular key for flow of cooling fluid.

15. The nozzle according to claim 14, comprising an adjusting pin engageable in an oblong opening substantially parallel to the longitudinal axis of said nozzle unit in an inner wall of the corresponding section of said plurality of sections of said outer shell to permit lateral adjustment of the plurality of sections of the nozzle unit and the associated separators.

16. The nozzle according to claim 4, wherein the resting radial flanges at ends of said nozzle unit include an inner return to increase contact surface with inner walls fo said outer shell, with joints being placed at the contact surface, and said separator in each end section of said plurality of section of said nozzle unit comprises two parts.

17. The nozzle according to claim 2, wherein at least one outer wall of said plurality of sections of said nozzle unit comprises stiffening ribs, and said separator is correspondingly shaped.

18. The nozzle according to claim 2, wherein a lower front side of a nose of said nozzle unit is backwardly slanted to define an angle of les sthan 90° with respect to the longitudinal axis passing through said nozzle unit.

19. The nozzle according to claim 2, comprising at a substantially plane part of the divergent, at a upstream end of said nozzle unit, a removable plate for local thermal control placed in continuity with said substantially plane part.

20. The nozzle according to claim 19, wherein said removable plate extends to another section of said nozzle unit.

21. The nozzle according to claim 19, wherein said removable plate comprises a cold plate including two assembled metal plates defining a fluid circulating circuit for a cooling fluid therebetween, and said fluid circulating circuit is capable of connecting to outside circuits via collectors fluid-tightly crossing one of said independent cooling fluid circulation chambers and a corresponding separator and outer shell section.

22. The nozzle according to claim 19, wherein said removable plate comprises a hot plate to reduce cooling, said hot plate comprising a silica foam plate and a metal sole assembled face to face.

23. The nozzle according to claim 2, wherein each section of said plurality of sections of said nozzle unit are of one piece construction of copper alloy.

24. The nozzle according to claim 23, wherein said copper alloy is electro-erosion machined.

25. The nozzle according to claim 1, wherein said flattened section of said divergent comprises a super-elliptic flattened section.

* * * * *

UNITED STATES PATENT AND TRADEMARK OFFICE

CERTIFICATE OF CORRECTION

PATENT NO. : 5,240,180

DATED : August 31, 1993

INVENTOR(S) : JEAN FEUILLERAT

It is certified that error appears in the above-indentified patent and that said Letters Patent is hereby corrected as shown below:

The Abstract should appear as follows:

---Water film cooling modular nozzle is provided a divergent having a length that is substantially longer than the diameter of the throat and having a flattened outlet section. A first metallic section forms the convergent, the throat and a beginning portion of the divergent, and at least one second metallic section forms at least one additional portion of the divergent. The first metallic section and the at least one second metallic section are assembled in an end to end relationship forming a nozzle unit having a plurality of sections. A fixed outer shell substantially coaxial with the nozzle unit defines with the nozzle unit independent cooling fluid circulation chambers for each of the first metallic section and the at least one second metallic section. A separator is positioned within each independent cooling fluid circulation chamber to confine cooling fluid flow against an outer wall of each of the first metallic section and the at least one second metallic section to independently cool each section of the nozzle unit with a thin cooling fluid film flowing at high speed, and a clearance is provided, along the longitudinal axis of nozzle unit, in relation to the outer shell in order to absorb thermal expansion of the first metallic section and the at least one second metallic section.---

Column 1, line 13, delete "the" (first occurrence).

Column 3, line 58, change "arbearing" to ---appearing---.

At column 7, line 39 (claim 1, line 6), change "throad" to ---throat---.

At column 7, line 52 (claim 1, line 19), change "ssection" to ---section---.

At column 8, line 42 (claim 14, line 6), change "spearator" to ---separator---.

At column 8, line 54 (claim 16, line 4), change "fo" to ---of---.

UNITED STATES PATENT AND TRADEMARK OFFICE

CERTIFICATE OF CORRECTION

PATENT NO. :5,240,180

DATED :August 31, 1993

INVENTOR(S) :JEAN FEUILLERAT

It is certified that error appears in the above-indentified patent and that said Letters Patent is hereby corrected as shown below:

At column 8, line 54 (claim 16, line 4), change "fo" to --of--.

Signed and Sealed this

Second Day of August, 1994

Bruce Lehman

*Attest:*

BRUCE LEHMAN

*Attesting Officer*

*Commissioner of Patents and Trademarks*